United States Patent [19]

Sakata

[11] Patent Number: 4,798,179

[45] Date of Patent: Jan. 17, 1989

[54] HYDRAULIC OIL FOR USE IN SEALED-TYPE, LASH ADJUSTERS

[75] Inventor: Masayasu Sakata, Niiza, Japan

[73] Assignee: Honda Giken Kogyo Kabushiki Kaisha, Tokyo, Japan

[21] Appl. No.: 62,889

[22] Filed: Jun. 16, 1987

[30] Foreign Application Priority Data

Jun. 17, 1986 [JP] Japan ..... 61-140878

[51] Int. Cl.[4] ..... F01L 1/14

[52] U.S. Cl. ..... 123/90.52; 123/90.58

[58] Field of Search ..... 123/90.52, 90.58; 252/33; 44/51

[56] References Cited

U.S. PATENT DOCUMENTS

| | | | |
|---|---|---|---|
| 3,495,577 | 2/1970 | Collins | 123/90.58 |
| 4,129,508 | 12/1978 | Fruihaut | 252/33 |
| 4,338,894 | 7/1982 | Kodama | 123/90.58 |

*Primary Examiner*—E. Rollins Cross

*Attorney, Agent, or Firm*—Lahive & Cockfield

[57] ABSTRACT

A hydraulic oil for a sealed-type lash adjuster is engine oil based, comprising mineral oil as a principal component, and 3% or less by weight of an additive which includes at least one of an anti-oxidant, a detergent-dispersant, a rust preventative, and an anti-foaming agent.

3 Claims, 2 Drawing Sheets

HYDRAULIC OIL FOR USE IN SEALED-TYPE, LASH ADJUSTERS

The present invention relates to a hydraulic oil for use in a lash adjuster incorporated in a valve mechanism of an internal combustion engine, and more particularly, to a hydraulic oil suitable for use in a sealed-type lash adjuster.

In one aspect this invention, a sealed-type lash adjuster is provided which comprises body means, plunger means, and diaphragm means cooperating with the body means and plunger means to define an oil cavity. In this embodiment hydraulic oil filling the cavity consists essentially, or solely, of mineral oil.

In another independent aspect of this invention, unique hydraulic oil is contemplated for use in a sealed-type lash adjuster which oil comprises mineral oil as a principal component, and 3% or less by weight of an additive which includes at least one of an anti-oxidant, a detergent-dispersant, a rust preventive, and an anti-foaming agent.

In describing the invention, reference will now be made by way of example but not limitation, to the appended drawings.

DRAWINGS

Figure 1:
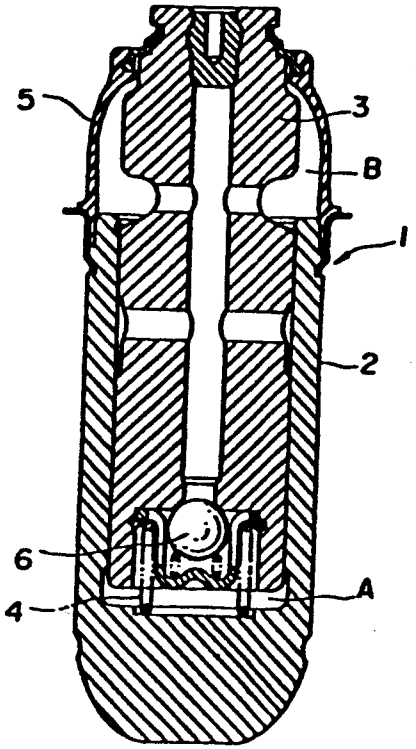
Figure 2:
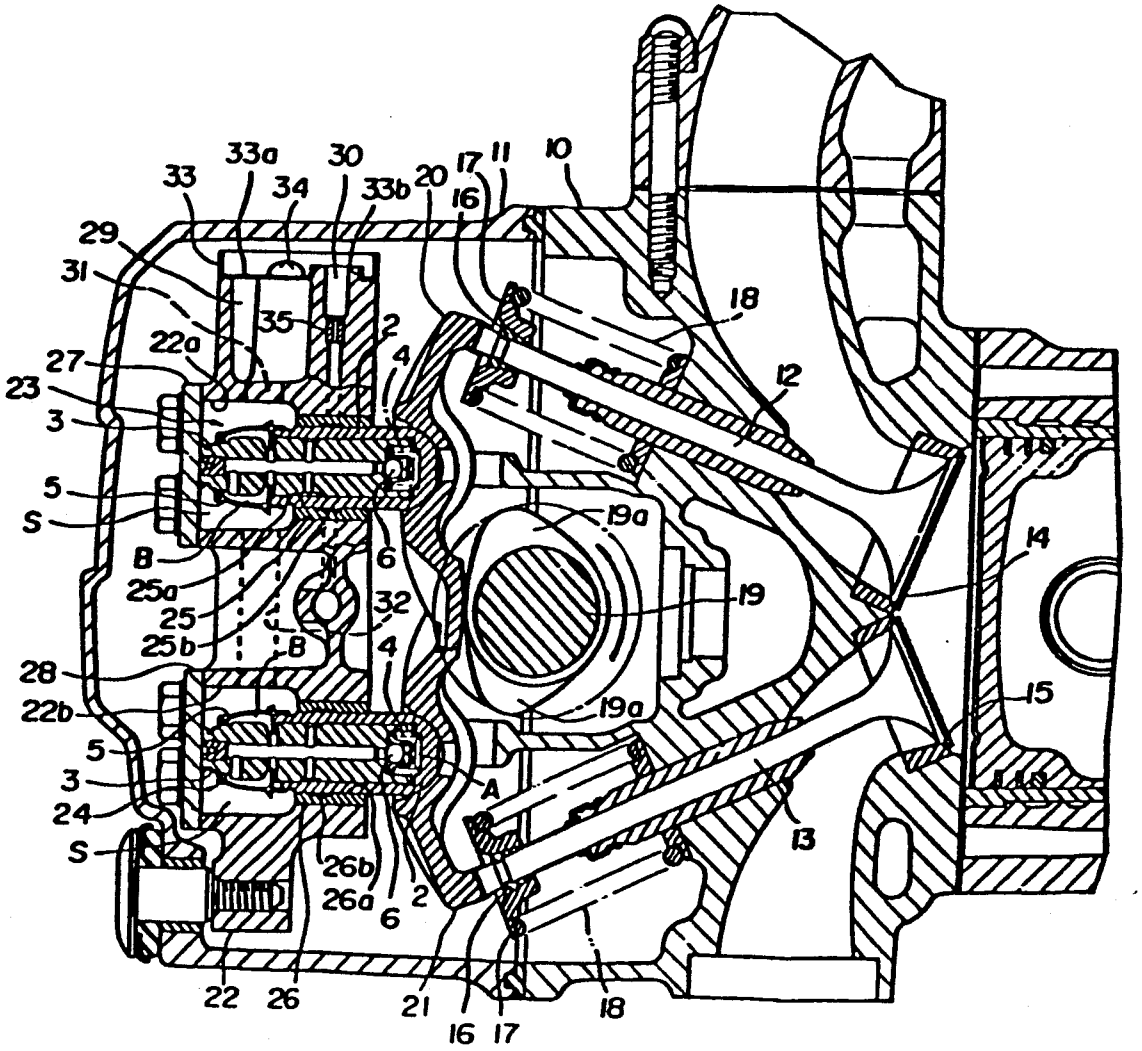

In brief, the appended drawings include:

FIG. 1, which provides a longitudinal, cross-sectional view of an example of a sealed-type lash adjuster; and FIG. 2 which povides a longitudinal, cross-sectional view of that portion of an internal combustion engine which incorporates a valve mechanism having the sealed-type lash adjuster.

In describing the invention, and in order to facilitate the discussion thereof, principal elements shown in the drawings include:

2 . . . body,
3 . . . plunger,
4 . . . plunger spring,
6 . . . check valve,
12 . . . suction valve,
13 . . . exhaust valve,
19 . . . cam shaft,
20, 21 . . . rocker arm,
22 . . . holder,
23, 24 . . . sealed-type lash adjuster,
A . . . high pressure chamber,
B . . . reservoir chamber, and
S . . . sealed space

GENERAL DESCRIPTION OF PRIOR ART AND PREFERRED EMBODIMENTS OF INVENTION

In the prior art, it is known, as to the valve mechanisms of internal combustion engines, to keep the gap between a valve body and a cam which opens and closes the valve body at zero by means of a lash adjuster. One example of such a lash adjuster will be described hereinunder by referring to FIG. 1.

As shown in FIG. 1, lash adjuster 1 comprises a cylindrical body 2 having a bottom, a plunger 3 slidably received in the body 2 and forming a high pressure chamber A. This chamber A is filled with hydraulic oil between the inner surface of the bottom portion of the body 2 and the plunger 3. A plunger spring 4, disposed between the plunger 3 and the body 2, urges the plunger 3 in its protruding direction, i.e. out of its body cavity. A flexible diaphragm 5 is mounted on the open end of the body 2 and the plunger 3 and cooperates with these elements to form a reservoir chamber B for the hydraulic oil to be supplied to the high pressure chamber A. A check valve 6 is incorporated in the high pressure chamber A for preventing the hydraulic oil from flowing into the reservoir chamber B from the high pressure chamber A. A lash adjuster of this type is referred to as a sealed-type lash adjuster.

Such a sealed-type lash adjuster generally employs silicone oil as the hydraulic oil. However, the cost of silicone oil is about 50 times as high as that of any of various types of engine oil, although it has a heat resistance of 200° C. of above and a remarkably high quality compared with what is normally required for an oil employed in an internal combustion engine.

The applicant of the present invention noticed the fact that normal engine oil is generally employed in an open-type hydraulic lash adjuster without causing any problems, and examined the use of engine oil as a hydraulic oil in place of silicone oil. Typical components of such an engine oil are:

(A) Principal component
Mineral oil—93.4%
(B) Additive
Anti-oxidant—1%
Detergent-dispersant—5%
Rust preventive—0.5%
Anti-foaming agent—0.1%
Examples for such additions include:

<<Anti-oxidant>>

For ultraviolet absorption:

[2-(2-hydroxy-5-methylphenyl)benzotriazole, 2-hydroxy-4-n-oxtoxybenzophenone]

For chain reaction stopping:

Phenol type [DBPC, 4-4′ methylenebis(2,6-dibutylphenol)]

Aromatic amine type [4,4′-tetramethyldiamino, diphenylmethane]

For peroxide decomposition:

Sulfur type [terpene sulfide, dialkylmonosulfide, olefin sulfide[

Zinc dithiophosphate type [Zn-DPT] and [Phosphoric ester]

For metal inactivation:

[Benzotriazole]

<<Detergent-dispersant>>

[Sulfonate, phenate, salicylate, phosphonate, succinic imide, benzine amine, succinate copolymer]

<<Rust preventive>>

[Carboxylic acid type (artinyl succinate), sulfonate (barium dinonylnaphthalene sulphonate), ester type (sorbitan monooleate), basic nitrogen compound (oleoyl sarcosine), phosphate, tiophosphate]

<<Anti-foaming agent>>

Silicone type [dimethyl polysiloxane, silicone emulsion]

Ester type [sorbiton monolaurate, artinyl succinate derivative]

Alcohol type [polyoxyalkylene glycol]

Metallic soap type [aluminum stearate, potassium oleate]

The lash adjuster 1 of FIG. 1 is mounted on the rocking center of a rocker arm which extends between a cam and a valve body. This lash adjuster is adapted to eliminate any gap formed between the rocker arm and the valve body or the cam by having the plunger 3 resiliently protrude out of the body 2 by means of the plunger spring 4 so as to move the rocker arm into engagement with the valve and/or the cam. Spring 4 also prevents the plunger 3 from collapsing into the body 2. The aforenoted gap is kept at zero by supplying the hydraulic oil from the reservoir chamber B to the high pressure chamber A via the check valve 6 on the basis of the relative movement of the body 2 and the plunger 3 and by sealing the supplied hydraulic oil in the high pressure chamber A by means of the check valve 6. In addition, changes in volume of the reservoir chamber B caused by the hydraulic oil flowing out are absorbed by the flexibility of the diaphragm 5.

The present invention is designed to overcome the following problems of the above-described prior art.

When the body 2 and the plunger 3 are repeatedly moved relative to each other in a sealed-type lash adjuster charged with a hydraulic oil containing the above-described components and having the above-described component ratios, the operational characteristics of the lash adjuster have been found to vary for some reason.

Through intensive studies, the applicant of the present invention noted the following facts which might be the cause of the above-described problems.

In a sealed-type lash adjuster, the hydraulic oil is exposed to high temperatures, and the hydraulic oil in the reservoir chamber B is caused to flow repeatedly through the narrow passage provided with the check valve 6 at high speed on the basis of the relative movement of the body 2 and the plunger 3. Such flow could cause sudden decreases in pressure and turbulence at high speed to occur repeatedly. This phenomena affects the hydraulic oil, so that foam is generated therein (it is considered that this is due to the additive contained in the hydraulic oil). This makes the volume of the hydraulic oil in the high pressure chamber A vary when the sealed-type lash adjuster 1 is contracted. Also, the additives mixed in the oil constituting the principal component of the hydraulic oil are caused to set or solidify due to some reaction thereof, and the resultant substance enters the fine gap formed between the plunger 3 and the body 2, preventing the smooth sliding thereof.

Inventive Solution to Prior Art Problem

In order to overcome the above-described problems, the present invention may be carried out in one form on the basis of the above-described knowledge by providing a hydraulic oil for use in a sealed-type lash adjuster which solely comprises mineral oil. In another aspect of the present invention, the hydraulic oil comprises mineral oil constituting the principal component thereof, and 3% or less of an additive which includes at least one of an anti-oxidant, a detergent-dispersant, a rust preventive, and an anti-foaming agent.

According to one aspect of the present invention, the hydraulic oil which solely comprises a mineral oil restricts the generation of foam as well as preventing the occurrence of solids formation or setting when the hydraulic oil flows in the sealed-type lash adjuster during the operation thereof. According to another aspect of the present invention, occurrence of the setting of the additives can be restricted by determining the types of additive to be combined and the amount in which they are added. As a result, it is possible to maintain the operating characteristics of the sealed-type lash adjuster.

Embodiments of Invention

Embodiments of the present invention will be hereinunder described in detail by referring to the accompanying drawings in which the identical reference numerals are applied to the parts corresponding to those shown in FIG. 1, so that the description thereof will be simplified.

FIG. 2 shows a valve mechanism of an internal combustion engine which incorporates a sealed-type lash adjuster according to the present invention, the valve train being described first below.

The valve mechanism is incorporated in a space defined between a cylinder head 10 and a head cover 11 secured thereto. It includes a suction valve 12 and an exhaust valve 13 slidably mounted in the cylinder head 10. These valves are respectively adopted to open or close a suction port 14 and an exhaust port 15 formed in the cylinder head 10 by respectively sliding the suction valve 12 and the exhaust valve 13 in their longitudinal directions. The suction valve 12 and the exhaust valve 13 are made to protrude into the aforenoted space. Each of the valves has a retainer 17 mounted onto the projecting and thereof through the wedging action of a divided cotter 16. A valve spring 18 extends between the retainer 17 and the cylinder head 10, by means of which the valve 12 or 13 is constantly urged in the direction in which it closes the port, and against the resillient force of which it is intermittently moved to an open position.

The valve mechanism further includes a cam shaft 19 rotatably mounted in the cylinder head 10 between the two valves 12, 13. Cam shaft 19 has a plurality of cams **19*a* formed as segments thereof. Rocker arms 20, 21 extend between the cam segments of cam shaft 19 and the protruded ends of the respective valves 12, 13 in such a manner as to be freely rockable. A holder 22 which may be made of an aluminum alloy, is secured to the cylinder head 10 separately from and in a mutually opposed relationship with the rocker arms 20, 21. Sealed-type lash adjusters 23, 24, according to the present invention, are slidably mounted on the holder 22. The rocking centers of the rocker arms 20, 21**, respectively, are pivotally engaged with these lash adjusters.

Bushings 25, 26, extending substantially in the horizontal direction (in the longitudinal direction in FIG. 4) are mounted on the holder 22 by, for example, by way of press fitting, so as to form guiding holes **25*a*, 26*a* into which the sealed-type lash adjusters 23, 24, respectively, are received. Recesses 22*a*, 22*b*, which respectively communicate with the guiding holes 25*a*, 26*a*, are formed on the side of the holder which is opposite to that which faces the rocker arms 20, 21, so that they form sealed spaces S when closed by lid bodies 27, 28**, respectively.

The upper portion of the holder 22 (i.e., the upper portion of FIG. 2) is provided with an upward opening oil reservoir 29 and an oil supply aperture 30 which extend substantially in the vertical direction (in the lateral direction of piston reciprocation of FIG. 2). The oil reservoir 29 communicates with the recesses 22*a*, 22*b* via passages 31, 32, respectively, while the oil supply aperture 30 communicates with peripheral grooves 25, 26 formed on the inner peripheral surfaces of the bushihgs 25, 26, respectively. Thus, the engine oil splashed up by the cam shaft 19 or the other moving members is supplied into the sealed spaces S and to the inner peripheral surfaces of the bushes 25, 26 on which the sealed-type lash adjusters 23, 24, respectively, slide.

The upper portion of the holder 22 is also provided with an oil receptacle 33 mounted thereon by means of a bolt 34 in such a manner that it covers the opening of the oil reservoir 29. The oil receptacle may be formed by, for example, pressing a metal thin plate. It has holes 33*a*, 33*b* connected to the oil reservoir 29 and the oil supply aperture 30, respectively, and through which the received engine oil is introduced thereto.

The oil supply aperture 30 incorporates an orifice 35 by which the amount of oil supplied to the inner peripheral surfaces of the bushes 25, 26 is adjusted or regulated.

The sealed-type lash adjusters 23, 24, according to the present invention, each have the same structure as that of the known lash adjuster shown in FIG. 1. Each of the lash adjusters is supported by the holder 22 in a state wherein the body 2 thereof is slidably received in the corresponding guiding hole 25*a* or 26*a*, and the protruding end of the plunger 3 and the diaphragm 36 or 37 forming the reservoir chamber B are both incorporated in the recess 22*a* or 22*b* charged with an engine oil while the protruding end of the plunger 3 abutts against the lid body 27 or 28. The spherical outer surface of the bottom portion of the body 2 engages with the rocking center of the rocker arm 20 or 21 so as to pivotally support the rocker arm 20 or 21. The body 2 is made to protrude outwardly from the holder 22 with the lid body 27 or 28 serving as a supporting member, so that the rocking ends of the rocker arm 20 or 21 abut against the cam 19*a* and the valve 12 or 13.

The high pressure chamber A, the reservoir chamber B and the gap formed between the body 2 and the plunger 3 in each of the sealed-type lash adjusters 23, 24 are charged with a unique lash adjuster hydraulic oil according to the present invention.

One form of the present invention will be described hereinunder by way of example.

One example of a hydraulic oil for use in a sealed-type lash adjuster according to this invention is mineral oil which satisfies the following conditions.

(a) Peak molecular weight—400 to 500

(b) Viscosity—40 to 50 St (40° C.); 10 St (100° C.)

(c) Additive—No additive employed

After the sealed-type lash adjusters 23, 24 charged with the hydraulic oil of this example had been incorporated in the valve mechanism constructed as shown in FIG. 2, the internal combustion engine was continuously run for 200 hours under the conditions that its rotational speed was 4000 to 7000 rpm and the temperature of the space in which the valve mechanism was incorporated was 145° C.±5° C. or below, so as to continuously operate the sealed-type lash adjusters 23, 24, and a compressive load of 3 to 10 kg was then applied thereto. When the relative movement of the bodies 2 and the plungers 3 or the change in volume of the hydraulic oil in the high pressure chamber A were measured thereafter, as well as the extension resistance of the plungers 3 relative to the bodies 2 (this being measured by pushing down the plunger 3 through a predetermined distance and by comparing the time which it takes for the plunger 3 to return after removing the load), the results were substantially the same as those obtained before the operation.

When the sealed-type lash adjuster 1 charged with a hydraulic oil which comprises mineral oil as a principal component and an additive mixed therein was continuously operated under the same conditions as described above, the results showed a change in the volume of oil in the high pressure chamber A of 2 to 6% and an extension resistance of 4 to 5%, and this example of hydraulic oil proved to be effective.

Next, another form of this invention will be described below.

In this form of the invention, a hydraulic oil comprises mineral oil as a principal component, and 3% or less of an additive which includes at least one of anti-oxidant, detergent-dispersant, rust preventive and anti-foaming agent, and examples of such a hydraulic oil will be given below:

EXAMPLE 1

A hydraulic oil was prepared by adding 0.1% of anti-oxidant (Zn-DPT) to 99.9% of mineral oil having a peak molecular weight of between 400 and 500 and a viscosity of between 40 and 50 St (40° C.) and 10 St (100° C.) which constituted the principal ingredient.

EXAMPLE 2

A hydraulic oil was provided in the same manner as in Example 1 with the exception that the same amount of detergent-dispersant was added in place of the anti-oxidant.

EXAMPLE 3

A hydraulic oil was provided in the same manner as in Example 1 with the exception that the same amount of rust-preventive (dinonyl naphthalenesulfinic acid) was added in place of the anti-oxidant.

EXAMPLE 4

A hydraulic oil was provided in the same manner as in Example 1 with the exception that the same amount of anti-foaming agent (dimethyl polysiloxane) was added in place of the anti-oxidant.

EXAMPLE 5

A hydraulic oil was prepared by adding 2% of detergent-dispersant (succnic acid imide) and 0.1% of rust-preventive (dinonyl naphthalenesulfinic acid) to 97.9% of mineral oil.

EXAMPLE 6

A hydraulic oil was prepared by adding 2% of detergent-dispersant (succinic acid imide), 0.1% or less of rust-preventive (dinonyl naphthalenesulfinic acid) and 0.1% or less of anti-foaming agent (dimethyl polysiloxane) to 97.9% of mineral oil.

EXAMPLE 7

A hydraulic oil was provided by adding 0.4% of anti-oxidant (Zn-DPT), 2% of detergent-dispersant (succinic acid imide), 0.1% or less of rust-preventive (dinonyl naphthalenesulfinic acid) and 0.1% or less of anti-foaming agent (dimethyl polysiloxane) to 97.5% of mineral oil.

The hydraulic oil of each of these examples was charged into the sealed-type lash adjuster constructed as shown in FIG. 1, and each sealed-type lash adjuster was operated under the same conditions as those used with the first form of this invention. When the change in the volume of the high pressure chamber A and the extension resistance of the plunger 3 with respect to the body 2 were measured thereafter in the same manner as was done with the first form of this invention, each example showed a volume variation of approximately 1% or less and an extension resistance of approximately 2% which represented a great improvement compared with the results of the prior art shown in the description of the first form of the present invention.

Recapitulating what has been described above, in one form of the present invention, a hydraulic oil solely comprises mineral oil, while in another it comprises mineral oil as the main ingredient and 3% of less of an additive which includes at least one of anti-oxidant, detergent-dispersant, rust-preventive and anti-foaming agent in another form of the present invention. Such inventive, sealed-type lash adjuster oils can endure for a long period of time the operating characteristics of a sealed-type lash adjuster operated at elevated temperatures, thereby improving its reliability to a great extent.

With preferred embodiments and the basic concepts of the invention having thus been described, those skilled in the engine art and familiar with the disclosure may recognize additions, deletions, substitutions, or other modifications which would fall within the purview of the invention as set forth in the appended claims:

What is claimed is:

1. A sealed-type lash adjuster comprising:

body means;

plunger means;

diaphragm means cooperating with said body means and plunger means to define an oil cavity; and hydraulic oil filling said cavity, said hydraulic oil being engine oil based and comprising mineral oil as a principal component, and 3% or less by weight of an additive which includes at least one of an anti-oxidant, a detergent-dispersant, a rust preventive, and an anti-foaming agent.

2. A sealed-type lash adjuster of claim 1 wherein said oil consists solely of mineral oil.

3. A sealed-type lash adjuster of claim 2 wherein said oil has a maximum molecular weight of about 500.

* * * * *